United States Patent [19]

Pariseau

[11] 4,332,155

[45] Jun. 1, 1982

[54] ROLLING MILL LAYING PIPE

[75] Inventor: David L. Pariseau, Southbridge, Mass.

[73] Assignee: Morgan Construction Company, Worcester, Mass.

[21] Appl. No.: 217,892

[22] Filed: Dec. 18, 1980

[51] Int. Cl.[3] ..... B21D 11/00

[52] U.S. Cl. ..... 72/66; 82/38 A

[58] Field of Search ..... 138/109; 82/38 A; 72/66; 193/2 R, 38

[56] References Cited

U.S. PATENT DOCUMENTS

| | | | |
|---|---|---|---|
| 1,904,329 | 4/1933 | Rich | 138/109 |
| 1,935,999 | 11/1933 | Teasly | 82/38 RJ |
| 2,915,089 | 12/1959 | Horsling | 82/38 A |
| 4,242,892 | 1/1981 | Wykes | 72/66 |

*Primary Examiner*—Leon Gilden

*Attorney, Agent, or Firm*—Thompson, Birch, Gauthier & Samuels

[57] ABSTRACT

A rolling mill laying pipe has a rigid external tube with an entry end for receiving a longitudinally moving mill product and an exit end through which the product is discharged. An intermediate portion of the tube between the entry and exit ends has a three-dimensionally curved configuration. A helical spring is axially received in and is radially confined by the tube. The spring is relatively tightly wound, with an inside diameter appropriately dimensioned to accommodate passage therethrough of the mill product. Retainer elements are provided at the tube ends for axially confining the spring within the tube. At least one of the retainer elements is detachable to permit removal and replacement of the spring.

8 Claims, 8 Drawing Figures

ROLLING MILL LAYING PIPE

BACKGROUND OF THE INVENTION

1. Field of the Invention

This invention relates generally to rod rolling mills, and in particular to an improved laying pipe for use in the laying heads of such mills.

2. Description of the Prior Art

Mill builders are constantly striving to increase mill delivery speeds in order to maximize the productive capacity of the mill equipment. For example, ten years ago a mill delivery speed of 50 meters/sec. for 5 mm. rod was considered "fast". However, the same product is being rolled currently at mill delivery speeds as high as 112 meters/sec. and still further speed increases are being contemplated.

These increases in mill delivery speeds have given rise to serious problems with regard to the design and maintenance of the laying pipes used in the laying heads. Again by way of example, if 5 mm. rod being delivered at a speed of 112 meters/sec. is to be formed into 1125 mm. diameter rings, the laying pipe must rotate at a speed of 1900 rpm. Under these conditions, the laying pipe is subjected to severe rotational stresses. However, a pipe material selected primarily for its ability to withstand such stresses often lacks the ability to adequately resist internal frictional wear without marking the surface of the product passing therethrough.

An attempt at solving this problem is disclosed in U.S. Pat. No. 4,074,553 where the laying pipe consists of an outer three-dimensionally curved tube lined with a plurality of replaceable inserts. The material from which the outer tube is fabricated is selected primarily for its ability to withstand rotational stresses, whereas the material for the replaceable inserts is selected for its ability to resist frictional wear without marking the surface of the mill product. Although this approach appeared to be theoretically sound, the relative complexity and high cost of the design prevented it from being put into actual practice.

SUMMARY OF THE INVENTION

The present invention provides an improved laying pipe having a rigid outer tube with an entry end through which the product is received and an exit end through which the product is discharged, with an intermediate portion of the tube between the entry and exit ends having a three-dimensionally curved configuration. The outer tube is selected from material capable of withstanding severe rotational stresses. A helical spring is axially received in the tube. The spring is wound relatively tightly and is selected from a material which has the capability of satisfactorily resisting frictional wear without scratching or otherwise marring the surface of the product passing therethrough. Appropriate retaining devices are located at the entry and exit ends of the outer tube to axially confine the spring therebetween.

The use of a spring rather than the multiple inserts employed in prior art constructions results in a simpler and less expensive arrangement. The spring can be rotatably adjusted within the outer tube in order to expose fresh unworn interior surface portions to the product passing therethrough. The spring can be easily withdrawn from the tube and replaced with a fresh spring when necessary.

These and other objectives and advantages of the present invention will become more apparent as the description proceeds with the aid of the accompanying drawings.

DESCRIPTION OF PREFERRED EMBODIMENT

Figure 1:
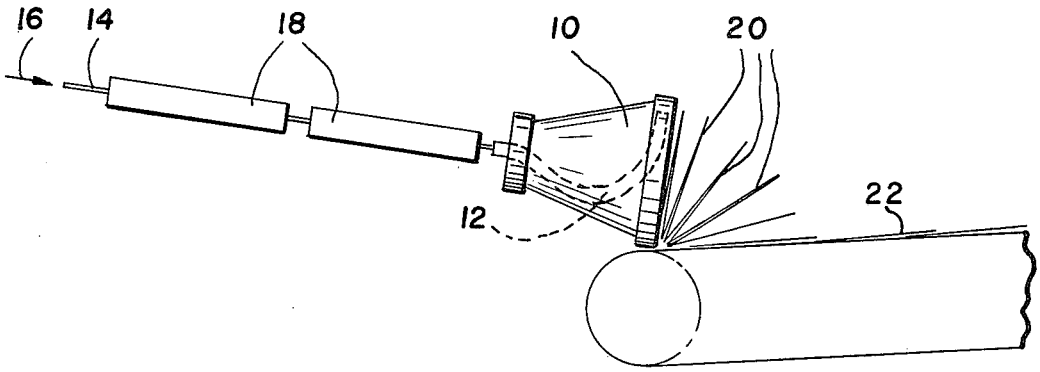
FIG. 1 is a schematic view in side elevation of a laying head embodying a laying pipe in accordance with the present invention.
Figure 3:
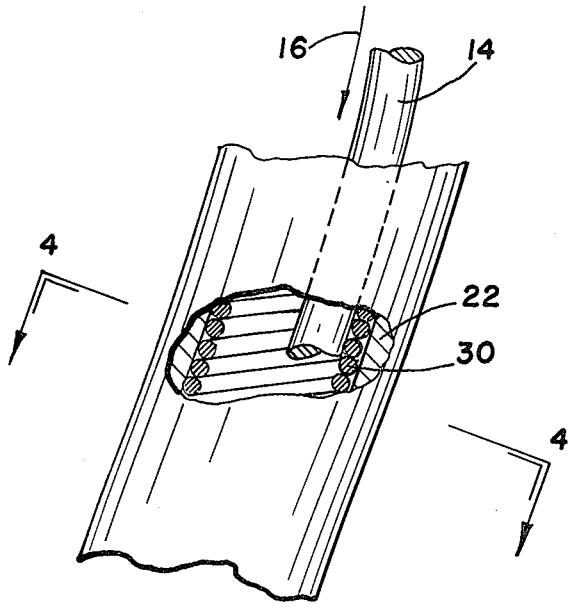
FIG. 3 is an enlarged side elevation of a segment of the laying pipe shown in FIG. 2, with a portion of the outer tube broken away.
Figure 4:
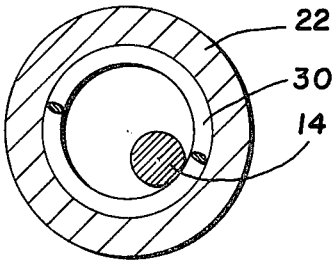
FIG. 4 is a cross sectional view taken along line 4—4 of FIG. 3.
Figure 2:
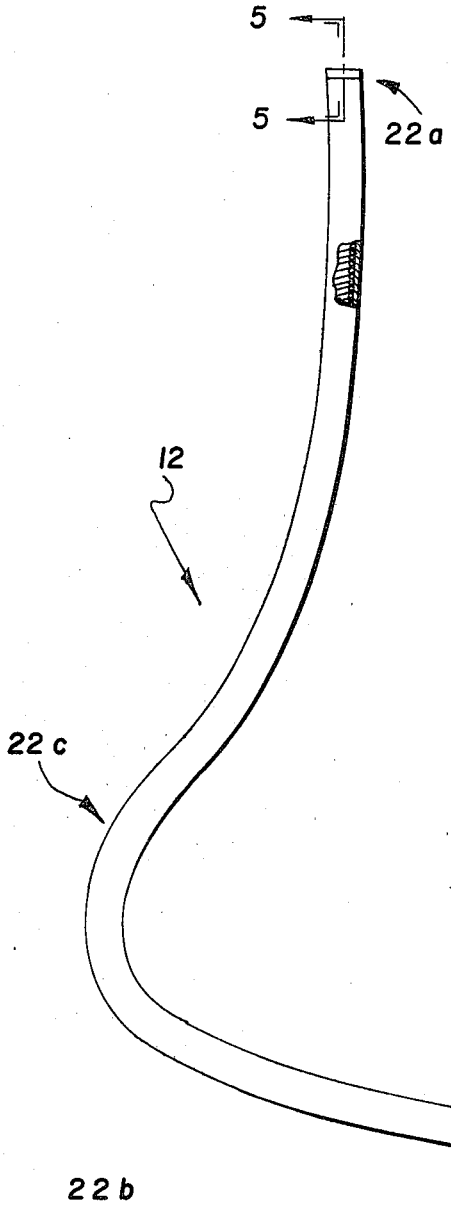
FIG. 2 is a three-dimensional view of a laying pipe in accordance with the present invention shown removed from the laying head.

Referring initially to FIG. 1, there is shown at 10 a laying head of conventional design containing a rotatable laying pipe 12. Mill product, for example hot rolled rod 14, is delivered longitudinally in the direction of arrow 16 by means of appropriate guides 18 into the receiving end of the laying pipe 12. The laying pipe is rotated by a drive (not shown) with the result that the rod is formed into a series of rings 20 which are deposited in an overlapping offset arrangement on a moving conveyor 21. This type of equipment is conventional and is well known to those skilled in the art.

Referring now to the remaining drawings, the laying pipe 12 of the present invention consists of a rigid outer tube 22 having an entry end **22*a* through which product is received and an exit end 22*b* through which product is discharged, with an intermediate portion 22*c* of the tube between the entry and exit ends having a three-dimensionally curved configuration. The outer tube 22** may be selected of any appropriate material with regard primarily to its mechanical properties, particularly the ability to withstand rotational stresses. One example of this type of material is cold drawn seamless steel tubing.

Figure 6:
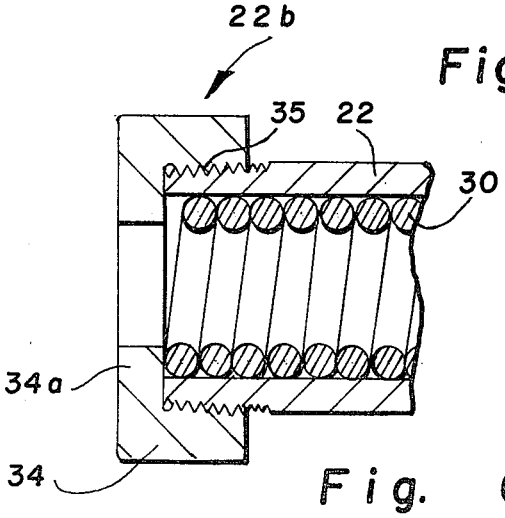
FIG. 6 is a sectional view taken along line 6—6 of FIG. 2.
Figure 7:
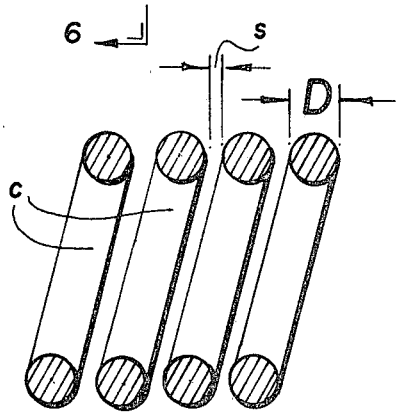
FIG. 7 is an enlarged partial view of a helical spring of the type employed in the present invention.

A relatively tightly wound helical spring 30 is axially received in the tube. With reference to FIG. 7, it will be understood that as herein employed, the term "relatively tightly wound" means that the spacing s between the spring coils c is less than one half the wire diameter D of the coils. In FIGS. 2, 3, 5 and 6 the spring 30 is tightly wound under tension, without any spacing between the coils, whereas in FIG. 5A, the spring 30 is provided with a slight spacing between coils on the order of that depicted in FIG. 7. The spring has an inside diameter appropriately dimensioned to accommodate passage therethrough of the hot rolled mill product 14. The spring is preferably selected of a suitable material having a satisfactory ability to withstand frictional wear without marking or otherwise marring the surface of the product 14 passing therethrough. An example of an acceptable spring material is 302 stainless steel.

The spring 30 is axially retained within the tube 22 by retainer means consisting of a bushing element 32 at the entry end 22*a* of the tube 20, and a collar 34 at the tube exit end 22*b*. As is best shown in FIG. 6, the collar 34 has a radially inwardly extending portion 34*a* against which abuts the end of spring 30. The collar 34 is removably mounted for example by being threaded as at 35 onto the tube end.

Figure 5A:
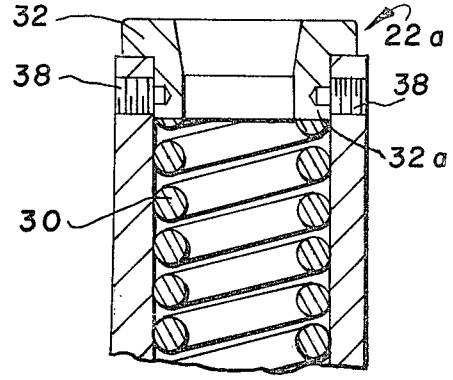
FIG. 5A is a sectional view similar to FIG. 5 showing a modified form of the invention.
Figure 5:
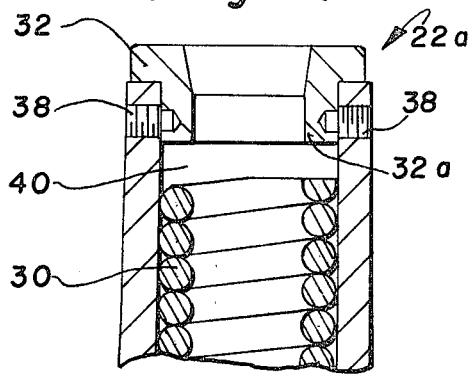
FIG. 5 is a sectional view taken along line 5—5 of FIG. 2.

As can be seen by referring to either FIGS. 5 or 5A, the bushing element 32 has a portion 32*a* partially inserted into the entry end 22*a* of the tube. The bushing element 32 is removably mounted in the tube end by means of set screws 38.

It will thus be understood that the spring 30 is confined against radial movement by the inside surface of the tube 22, and is confined axially within the tube between the retaining elements 32, 34.

Where the spring 30 is tightly wound under tension as shown for example in FIG. 5, it may be desirable to provide a space 40 between the spring end and the bushing portion 32*a* in order to accommodate any thermal expansion of the spring. However, as shown in FIG. 5A, when a spacing exists between spring coils, the spring end can abut against bushing portion 32*a*.

By removing one or both of the retainer elements 32, 34 access can be had to the spring 30. If a portion of the interior surface of the spring has become worn due to frictional contact with the product, the spring can be rotated within the tube to move the worn portion away from the path of the product, thereby exposing a fresh unworn portion for further use. If the spring is entirely worn, it can be axially removed from the tube 22 and a new spring can be readily inserted in its place. This can be accomplished quickly and efficiently at a minimum cost to the mill owner.

I claim:

1. In a rolling mill, a rotatable laying pipe for forming a hot rolled mill product moving longitudinally at high mill delivery speeds into a series of interconnected rings, said laying pipe comprising:

a rigid tube having an entry end through which the product is received and an exit end through which the product is discharged, with an intermediate portion of said tube between said entry and exit ends having a three-dimensionally curved configuration;

a helical spring axially received in said tube, said spring being relatively tightly wound and having an inside diameter appropriately dimensioned to accommodate passage therethrough of said product, the entire length of said spring being confined against radial movement by the inside diameter of said tube; and retainer means at the entry and exit ends of said tube for axially confining said spring therebetween.

2. The laying pipe of claim 1 wherein at least one of said retainer means is removably attached to said tube to accommodate axial replacement of said spring.

3. The laying pipe of claim 1 wherein said spring is tightly wound under axial tension, and wherein a space is provided between the end of said spring and the retainer means at the entry end of said pipe.

4. The laying pipe of claim 1 wherein said spring is provided with a spacing between coils which is less than one half the wire diameter of the coils.

5. The laying pipe of claim 4 wherein the opposite ends of said spring are in abutting relationship with said retainer means.

6. The laying pipe of claim 1 wherein said spring is rotatably adjustable within said tube.

7. The laying pipe of claim 1 wherein said spring is confined against radial movement by the inside surface of said tube.

8. A rolling mill laying pipe for forming a hot rolled mill product moving longitudinally at high mill delivery speeds into a series of interconnected rings, comprising:

a rigid external tube having an entry end for receiving a longitudinally moving mill product and an exit end through which the product is discharged, with an intermediate portion of said tube between said entry and exit ends having a three-dimensionally curved configuration;

a helical spring axially received in said tube, said spring being wound relatively tightly and being rotatably adjustable within said tube, the inside diameter of said spring being appropriately dimensioned to accommodate passage therethrough of said product, the entire length of said spring being confined against radial movement by the inside diameter of said tube; and retainer means for axially confining said spring within said tube.

* * * * *